United States Patent [19]

Knabel et al.

[11] Patent Number: 4,466,634

[45] Date of Patent: Aug. 21, 1984

[54] HEEL HOLDER FOR SAFETY SKI BINDINGS

[75] Inventors: Walter Knabel, Murnau; Ludwig Wagner, Farchant, both of Fed. Rep. of Germany

[73] Assignee: MARKER Patentverwertungsgesellschaft mbH., Baar, Switzerland

[21] Appl. No.: 387,423

[22] Filed: Jun. 11, 1982

[30] Foreign Application Priority Data

Jun. 12, 1981 [DE] Fed. Rep. of Germany ..... 3123435
Feb. 19, 1982 [DE] Fed. Rep. of Germany ..... 3206051

[51] Int. Cl.³ ..... A63C 9/08
[52] U.S. Cl. ..... 280/632
[58] Field of Search ..... 280/626, 631, 632, 633, 280/628

[56] References Cited

U.S. PATENT DOCUMENTS

| | | | |
|---|---|---|---|
| 3,620,545 | 11/1971 | Korger et al. | 280/632 |
| 3,734,520 | 5/1973 | Hashioka | 280/632 |
| 3,836,163 | 9/1974 | Hashioka | 280/632 |
| 3,933,363 | 1/1976 | Schweizer et al. | 280/632 |
| 4,060,257 | 11/1977 | Jungkind et al. | 280/626 |
| 4,111,453 | 9/1978 | Krob | 280/626 |

FOREIGN PATENT DOCUMENTS

| | | | |
|---|---|---|---|
| 275372 | 1/1969 | Austria | 280/632 |
| 273757 | 8/1969 | Austria | 280/631 |
| 296839 | 2/1972 | Austria | 280/632 |
| 1578981 | 9/1975 | Fed. Rep. of Germany | 280/632 |
| 1477758 | 4/1967 | France | 280/626 |
| 460609 | 9/1968 | Switzerland | 280/632 |
| 464037 | 11/1968 | Switzerland | 280/626 |

*Primary Examiner*—Joseph F. Peters, Jr.
*Assistant Examiner*—Michael Mar
*Attorney, Agent, or Firm*—D. Peter Hochberg

[57] ABSTRACT

A manually releasable heel holder of a safety ski binding having a housing, a sole holder, a connecting arm movably connected to the housing and to the sole holder, and a manually actuable releasing member for releasing the connecting arm from a locking to an unlocking position, allowing the sole holder to open under the influence of a spring.

13 Claims, 8 Drawing Figures

HEEL HOLDER FOR SAFETY SKI BINDINGS

BACKGROUND OF THE INVENTION

This disclosure relates to a manually releasable heel holder for safety ski bindings, which heel holder comprises a housing, a sole holder, a connecting arm movably connected to the housing and the soleholder, and a manually actuable releasing member for releasing the connecting arm from a locking position to an unlocking position, allowing the sole holder to open under the influence of a spring. Preferably, a heel holder according to this disclosure further comprises at least one stop means for returning the connecting arm to the locking position when the heel holder attains its open position from its closed position or vice versa.

A heel holder according to this disclosure is an improvement over known heel holders in that it can be deliberately released to its open position in a simple manner and it is movable to, and will remain in, its closed position regardless of whether it engages a ski boot. These advantages are achieved with a resulting heel holder that is both smaller and more lightweight than most existing heel holders.

Many conventional ski bindings have the disadvantage that the sole holder remains in an open position unless engaged with a ski boot. This is undesirable because, among other reasons, the binding may be unprotected during transportion from possible damage by external sources. For instance, salt water may be splashed into the binding while it is transported on the roof of a car. Additionally, conventional ski bags will often not accommodate open bindings. A binding according to this disclosure, however, may be closed by hand for transportation and storage, and may be easily reopened when necessary.

Heel holders according to this disclosure have the additional advantage that the soleholder automatically opens when the ski boot is released from the ski by the toe unit. This eliminates the need to manipulate the heel holder when the skier desires to step into the binding after a release in response to a twisting fall. To achieve this latter improvement, a heel holder according to this disclosure preferably further comprises an interim means for releasing the connecting arm from a locking to an unlocking position when the housing is moved toward the forward end of the ski under spring influence after release of the ski boot at the toe unit. On release from the locking to the unlocking position, the sole holder rotates from its closed to its open position.

Additional features of a heel holder according to this disclosure are apparent.

DESCRIPTION OF THE PREFERRED EMBODIMENTS

Figure 1:
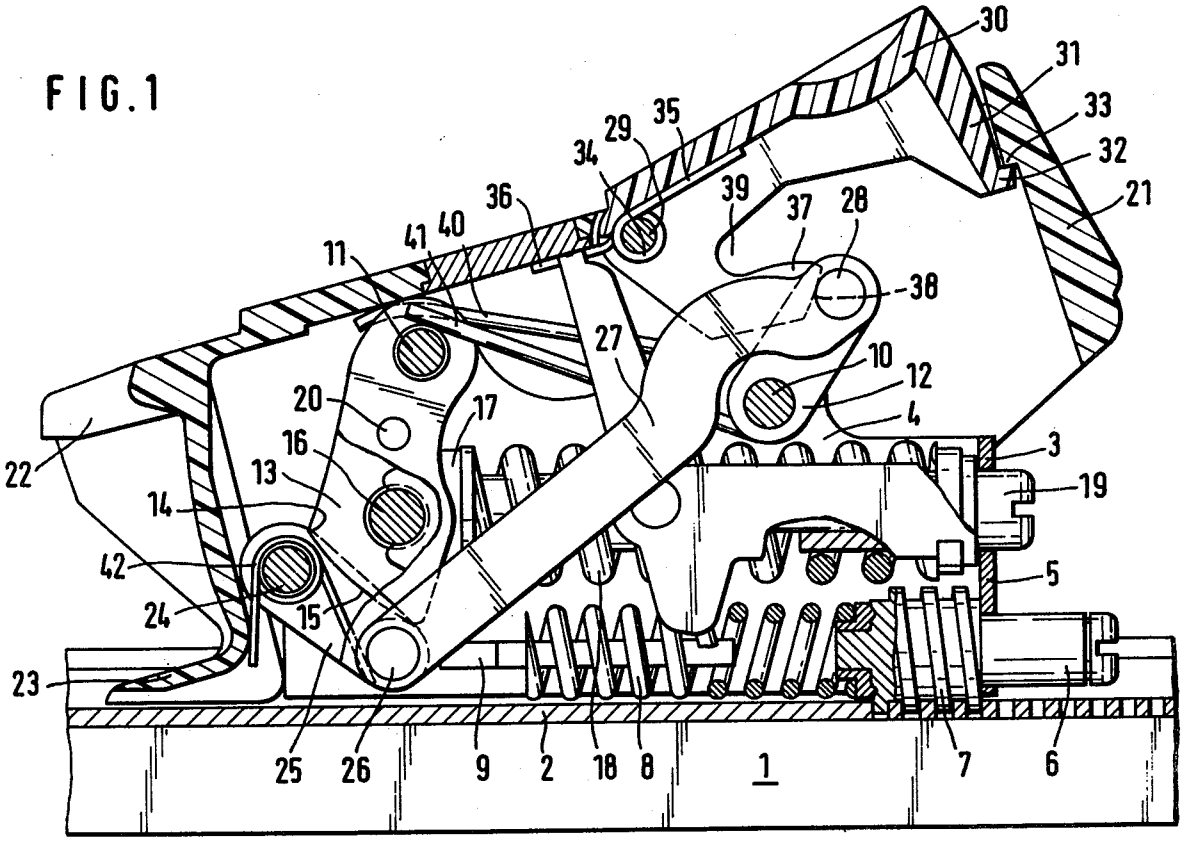
FIG. 1. A longitudinal cross-section of a manually releasable heel holder according to this disclosure in the closed position.
Figure 2:
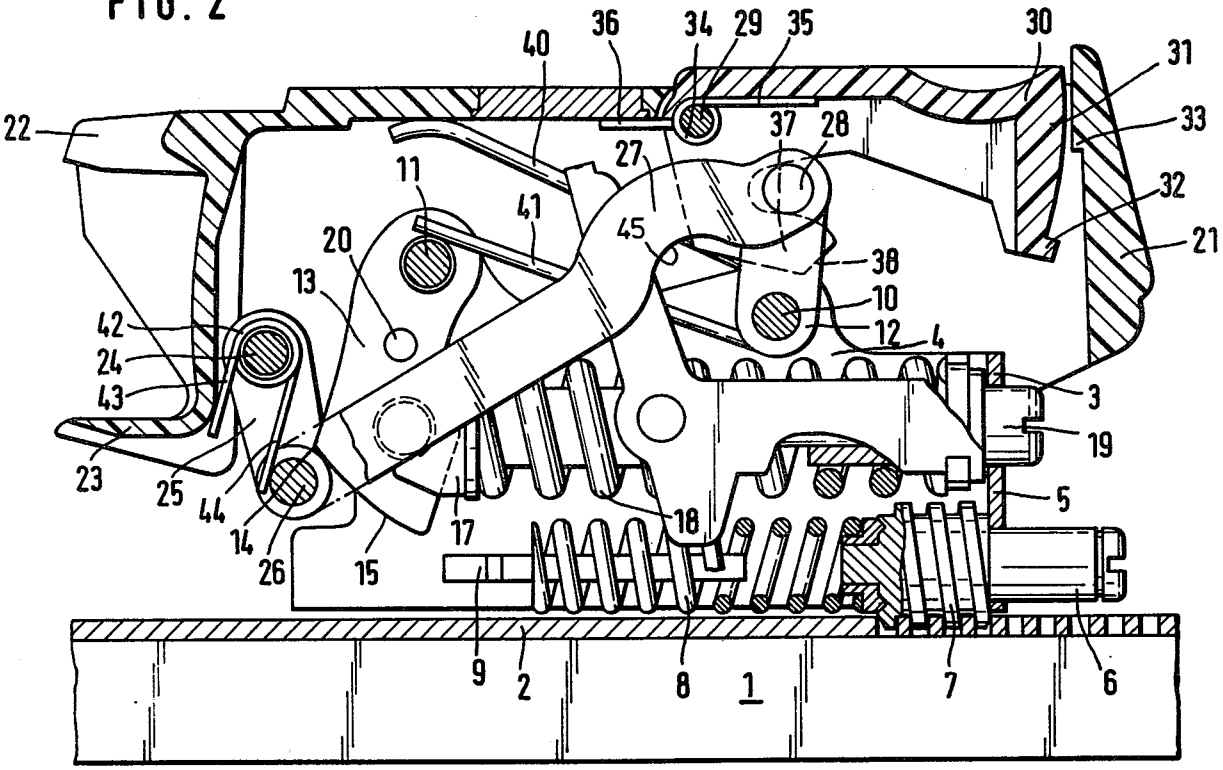
FIG. 2. A longitudinal cross-section of a manually releasable heel holder according to FIG. 1 in the position at the moment after the release lever is operated.

Turning to the drawings, FIG. 1 and FIG. 2 show a heel holder according to this disclosure as comprising an essentially U-shaped carriage or housing 3 slidably mounted on a base plate 2 for movement lengthwise along a ski. The base plate 2 is fixed to a ski 1. The housing 3 consists of side walls 4 connected by a bridge part 5. One side wall 4 has been broken away to allow for clear illustration of the inner components of the binding. (In all of the figures, the left hand end of the illustrated device faces the front or forward end of the ski, and the right hand end of the illustrated device faces the back or rearward end of the ski).

An adjustment screw 6 is twistably mounted in a hole in the bridge part 5, with generally rectangular screw threads 7 engaging mating threads in the base plate 2. The front of the screw 6 forms a base for a pressure spring 8 which biases housing 3 longitudinally towards its most forward position when no ski shoe is held in the binding. The other end of the pressure spring 8 engages a crosspiece 9, which extends between the side walls 4 of housing 3.

Pivot pins 10, 11 are secured in the side walls 4 of the housing 3. A crank 12 is pivotally attached to pivot pin 10 while a blocking member 13 is pivotally attached to pivot pin 11. The blocking member 13 has at its bottom end with an oblique cam surface 15 extending downwardly from corner 14. The blocking member 13 preferably comprises two identically shaped pieces connected together. A formed piece 17 is engaged by a spring 18. Piece 17 engages an axle 16 extending between the two pieces of member 13. The other end of spring 18 is pressed against a spring adjustment screw 19 which is screwed into the bridge-part 5 of housing 3. Spring 18 biases member 13 clockwise about pivot 11. Preferably, blocking member 13 is further provided with a peg 20 which borders on the swivel angle of blocking member 13. Peg 20 may function as a stop for blocking lever 13, limiting movement of said blocking lever to the left with respect to FIG. 1. A counterstop (not shown) for peg 20 is also provided, preferably on housing 3.

A sole holder 21 is pivotally mounted on pivot pin 10, and comprises a heel holding portion 22 for engaging the top of the heel of a boot and a pedal 23. The sole holder 21 is generally constructed as a casing and essentially covers the housing 3.

Sole holder 21 carries a hinge pin 24 near pedal 23, and one end of a locking means in the form of a locking lever 25 is pivotally mounted on pivot pin 24. A second hinge pin 26 is mounted on the other end of the lever 25. A connecting arm 27 is hinged at one of its ends to lever 25 by means of hinge pin 26 while the other end of arm 27 is hinged to crank 12 by a crank pin 28 mounted on crank 12. As with the blocking member 13, the locking lever 25 preferably comprises two identically shaped parts connected by first hinge pin 24 and second hinge pin 26.

An opening is provided in the sole holder 21, and a release lever 30, pivotally mounted to a joint pin 29, extends across that opening. The release lever 30 is provided with an angled elbow 31 which has at its bottom a ledge 32 which is pressed against a ledge 33 on the sole holder when the release lever 30 is in its rest or inactive position. The coiled part of a torsion spring 34 is mounted on joint pin 29. The arms 35, 36 of torsion spring 34 contact the sole holder 21 on one side of the joint pin 29 and the release lever 30 on the other side to bias lever 30 counterclockwise about pin 29. Release lever 30 has on its underside a retaining means in the form of a projection defining a ledge 37. Ledge 37 has an abutment surface 38 against which the crank pin 28 presses when release lever 30 is in its rest position, as shown in FIG. 1.

Release lever 30 actuates the manual opening mechanism of a sole holder according to this invention. When release lever 30 is depressed, crank pin 28 glides over the top of abutment surface 38 and moves into the fork gap 39 formed by ledge 37 and the bottom of lever 30. As illustrated in FIG. 1, crank 12 and arm 27 form a very acute angle, thus providing little resistance to the depression of lever 30. When lever 30 is depressed, hinge pin 26 connecting lever 25 with arm 27, functions as a follower means or cam follower and moves across cam surface 15 with almost no effort. A sleeve or rollers can be provided on pin 26 to facilitate the cooperation between pin 26 and cam surface 15. A torsion spring with arms 40, 41 is mounted on pivot pin 10, with arm 40 contacting pivot pin 11 and arm 41 contacting the underside of the sole holder 21 to bias sole holder 21 clockwise about pivot pin 10. This torsion spring forces the sole holder to its open position upon depression of the release lever 30 and the concomitant movement of pin 26 simultaneously with pin 28.

To ensure the return of the crank pin 28 to its blocked position on abutment surface 38 after use of release lever 30, a torsion spring 42 is mounted on first hinge pin 24, with one arm 43 biased against sole holder 21 and the other arm 44 urging second hinge pin 26 counter clockwise about pin 24. Spring 42 thus exerts force on arm 27 to urge pin 28 rearward across ledge 37 and onto surface 38, the latter having returned to its initial position through the force of spring 34 on lever 30.

Depression 45, formed by an angling of arm 27 prevents pivot pin 10 from interfering with connecting means 27 when sole holder 21 is in the closed position.

Figure 3:
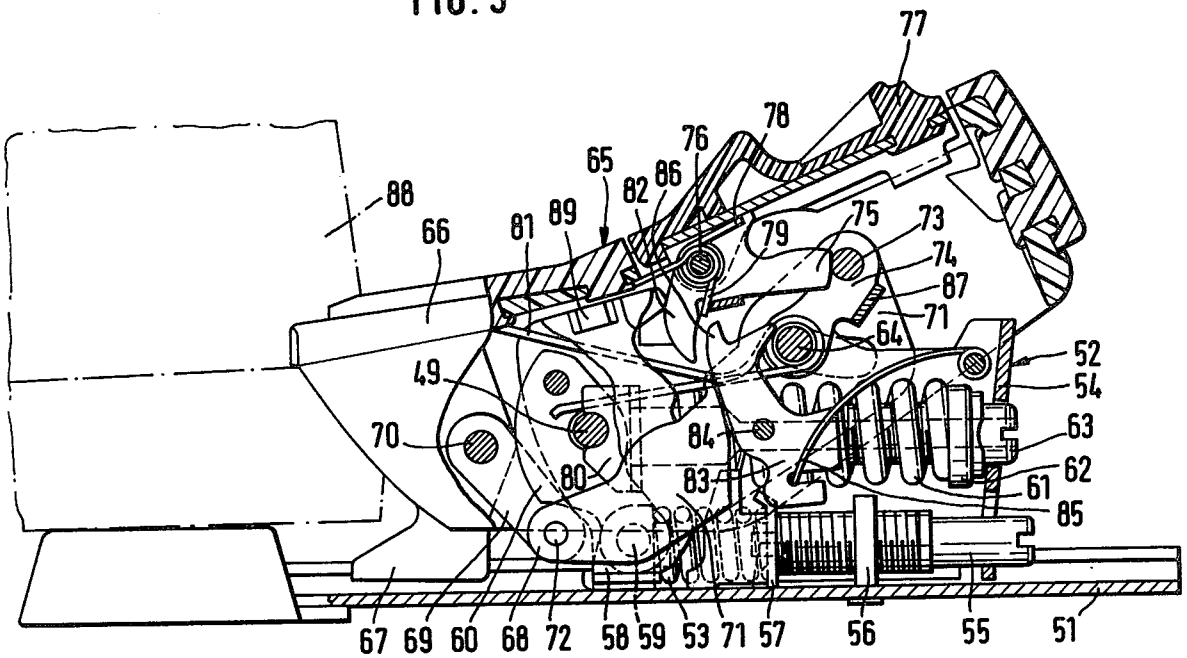
FIG. 3. A longitudinal cross-section of another heel holder according to this disclosure in the closed position with inserted ski shoe and having a manually releasable feature, stops, and an interim means.

FIG. 3 to FIG. 8 illustrate another heel holder according to this disclosure. FIG. 3 shows a heel holder in its closed position with an inserted ski shoe 88 (partially shown). The heel holder comprises support means in the form of a carriage or housing 52 slidably attached to a base plate 51, which base plate 51 is attached to a ski (not shown). Housing 52 has a pair of parallel side walls connected by cross wall 54. Housing 52 is under the influence of a pressure spring 53 which biases housing 52 towards the front of the ski. An adjusting screw 55 is screwed into a threaded hole of a holding part 56 with the end of the screw extending through a hole cross wall 54 of housing 52. Holding part 56 is fixably attached to base plate 51. Adjusting screw 55 includes a fixed stop 57 which is not movable in the lengthwise direction of the ski, the purpose of which will be described hereinafter. Stop 57 is preferably a stamped sheet metal piece, and also serves as a base over which pressure spring 53 presses against adjusting screw 55. The other end of the pressure spring 53 presses against a cross axle 59 which extends between the side walls of housing 52. A blocking member 60 is mounted on cross axle 59 and is biased counterclockwise by one end of a spring 61, while the other end of spring 61 presses against a nut 62 controlled by an adjusting screw 63, which extends through a hole in cross wall 54 of housing 52.

A swivel axle 64, parallel to cross axle 59, is mounted in the side walls of housing 52. A sole holder 65 pivots about swivel axle 64. Also mounted on swivel axle 64 is a torsion spring 81 with one arm contacting the upper surface of a cross axle 49 and the other arm contacting the lower surface of the soleholder 65. Spring 81 biases sole holder 65 toward the open position shown in FIG. 6. Sole holder 65 includes a heel holding portion 66 and a pedal 67. A sleeve or roller 68 is preferably pivotally mounted on an axle 72. Sleeve or roller 68 is provided to facilitate cooperation between axle 72 and blocking member 60. Also mounted on axle 72 is a locking lever 69 with the other end of locking lever 69 pivotally attached to a horizontal cross axle 70 mounted in sole holder 65. Also mounted on axle 72 is one end of a connecting arm 71 which is connected at its other end to a joint pin 73 attached to crank 74, the latter being pivotally mounted to swivel axle 64.

Joint pin 73 normally presses against the end of an abutment piece 75 which is mounted in sole holder 65 on an axle pin 76 which is parallel to sole holder axle 64. An opening in sole holder 65 contains a release lever 77 pivotally mounted to axle pin 76. Release lever 77 is biased counterclockwise to its reset position, shown in FIG. 3, by a stabilizing spring 78 which is a torsion spring mounted on axle pin 76 with one arm contacting the underside of the sole holder 65 and the other arm contacting the underside of release lever 77. Abutment piece 75 is spring influenced by a torsion spring 79 which is mounted on axle pin 76 with one arm of spring 79 contacting the underside of sole holder 65 and the other arm contacting abutment piece 75 in such a manner that abutment piece 75 is biased in a counterclockwise direction. Spring 79 is weaker than spring 78. Abutment piece 75 is preferably a separate piece from release lever 77, although in its rest position, it presses against release lever 77.

A release arm 82, preferably part of abutment piece 75, may be engaged by an interim means shown here in the form of an interim lever 83 which is pivotally mounted at an axle pin 84. Axle pin 84 extends between the side walls of housing 52 and is parallel to swivel axle 64. The interim lever 83 is spring biased in a clockwise direction towards a substantially vertical position by a bent spring 85, with one end of the bent spring contacting housing 52 and the other end contacting interim lever 83. As shown in FIG. 3, when sole holder 65 is in the closed position with a ski boot inserted, bent spring 85 influences interim lever 83 in such a manner that interim lever 83 contacts swivel axle 64. A finger 86, integral with part of the interim lever 83, is provided for contacting release arm 82 to provide for automatic opening of the sole holder on release of the ski boot, as described further hereinafter.

Several of the components of the above heel holder according to this disclosure preferably comprise two congruent stamped sheet metal pieces which are connected by the previously described cross axles and axle pins with which they are associated. Such components are the blocking member 60, the locking lever 69, the connecting arm 71, and the crank 74. The two congruent portions of the crank 74 are also connected by a bridge part 87. The two parts of arm 71 are located along the outside of the side walls of housing 52, all the other parts located in the area between the side walls of housing 52.

FIG. 3 illustrates a heel holder according to this disclosure in a closed position with the ski boot inserted. The ski boot 88 has housing 52 pulled over sole holder 65, forcing housing 52 and sole holder 65 to the right as shown in FIG. 3 against the force of pressure spring 53. If an upward force is applied at heel holding portion 66 of the sole holder 65, with this force being greater than the counter force applied by spring 61, a safety opening of the heel holder will occur with axle 72 forcing blocking member 60 to move the right as shown in FIG. 3 against the force of spring 61, with sole holder 65 taking on its open position illustrated in FIG. 6.

Figure 4:
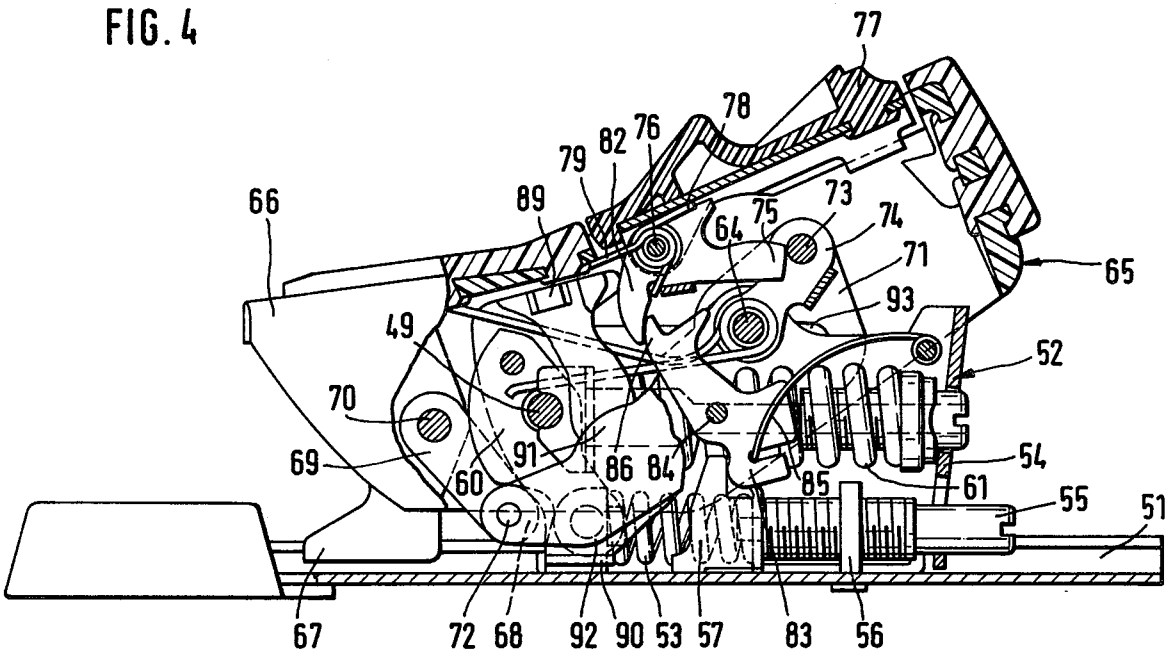
FIG. 4. A longitudinal cross-section according to FIG. 3 at the moment of automatic opening.

Automatic opening of sole holder 65 on release of ski boot 88 by the toe unit is illustrated by FIGS. 3 and 4. As previously described, FIG. 3 illustrates a heel holder in the closed position with a ski boot inserted. FIG. 4 illustrates a heel holder at the moment of automatic opening with the ski boot removed. Pressure spring 53 forces housing 52 forwardly. Before cross wall 54 abuts spindle 55, interim lever 83 is carried into stop 57 causing finger 86 of lever 83 to contact release arm 82, forcing abutment piece 75 to pivot in a clockwise direction about axle pin 76 against the force of stabilizing spring 79. This movement of abutment piece 75 frees joint pin 73 from contact with the end of abutment piece 75 and allows for movement of joint pin 73 along the upper or sliding surface of abutment piece 75. Release of joint pin 73 allows for counterclockwise movement of crank 74 about swivel axle 64 and allows for opening of sole holder 65 under the influence of opening spring 81 since axle 72 is no longer blocked by connecting arm 71 from movement about blocking member 60. The soleholder passes through the opening phase illustrated in FIG. 5 before reaching the full opening position illustrated in FIG. 6.

Figure 5:
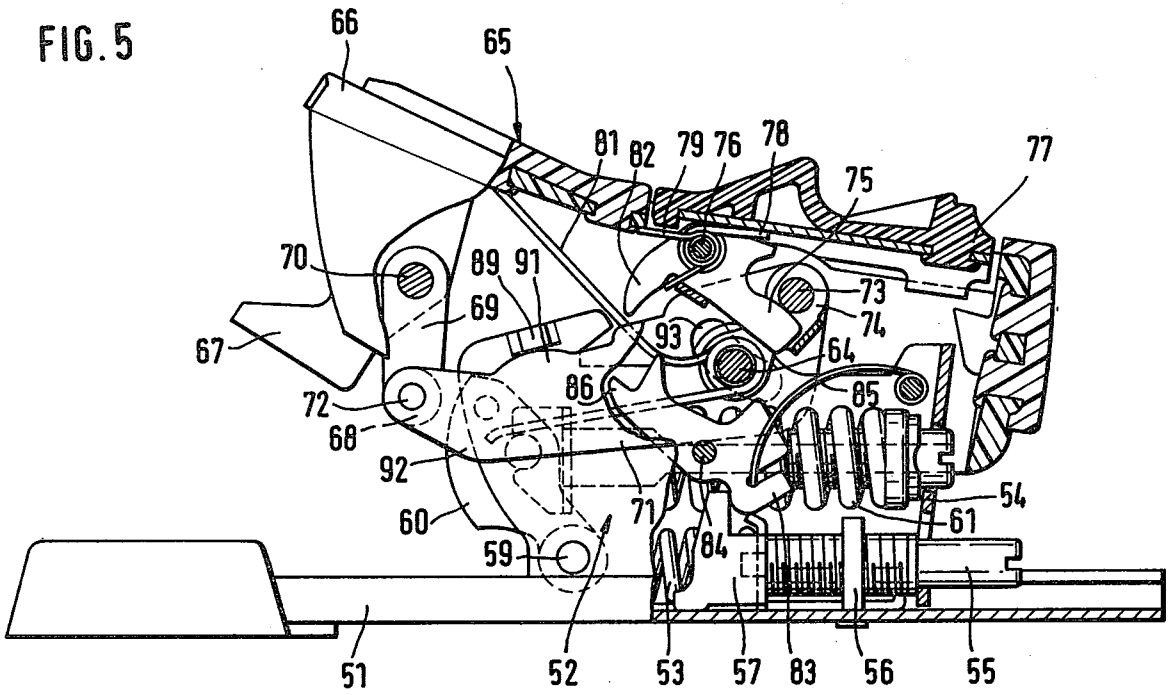
FIG. 5. A longitudinal cross-section according to FIG. 3 shown during the opening phase prior to full opening.
Figure 6:
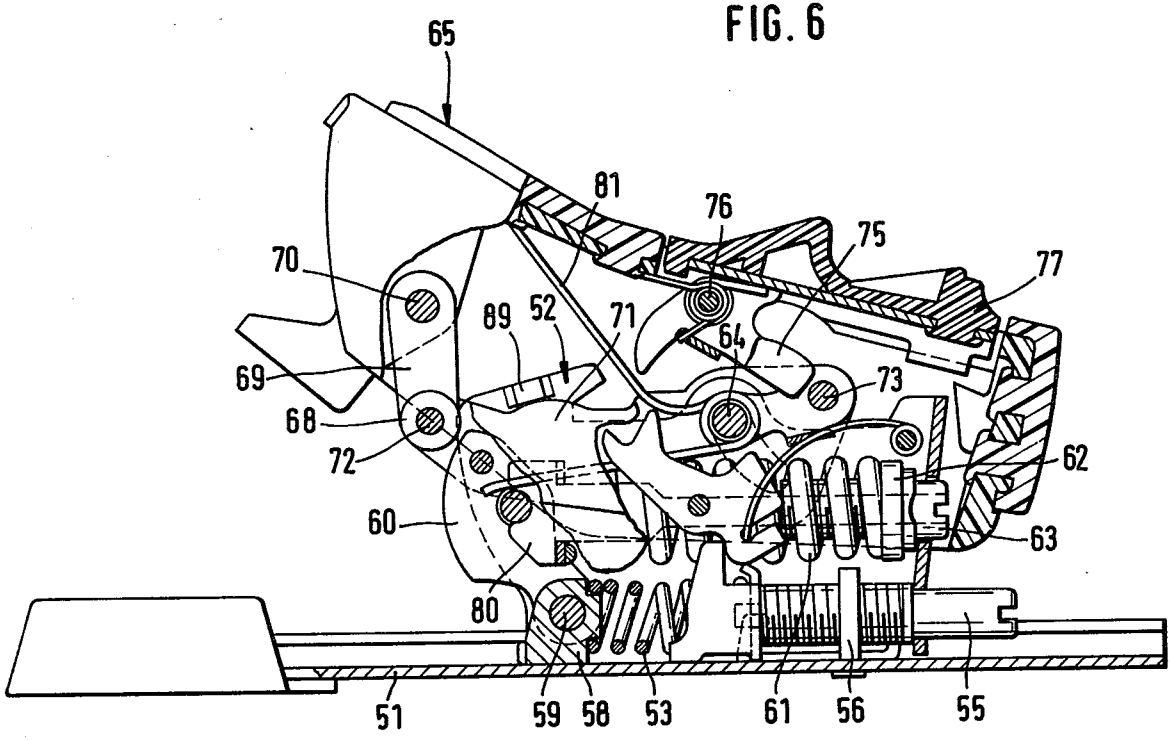
FIG. 6. A longitudinal cross-section according to FIG. 3 in the open position.

To ensure that the joint pin 73 does not interfere with the movement of abutment piece 75 and to ensure that abutment piece 75 is in the abutment position with respect to joint pin 73 when the sole holder is in the fully opened position illustrated in FIG. 6, a stop 89 is provided, preferably on the side wall of housing 52. As illustrated in FIG. 5, before sole holder 65 reaches a fully opened position, connecting arm 71 contacts stop 89. At this time, joint pin 73 is above abutment piece 75. As sole holder 65 continues its rotation into the open position about axle 64, connecting arm 71 pivots clockwise about the point of contact between stop 89 and arm 71. Crank 74 continues its rotation with the rotation of sole holder 65 about axle 64. This movement forces joint pin 73 from the upper surface of abutment piece 75, and the abutment piece, under the influence of stabilizing spring 79, returns to a position in which joint pin 73 is opposite the end of abutment piece 75. Movement of connecting arm 71 is guided by a slot 93 in arm 71 through which axle 64 extends. To reduce the size and weight of arm 71, a cam 91, part of arm 71, is preferably provided for contacting stop 89.

Figure 8:
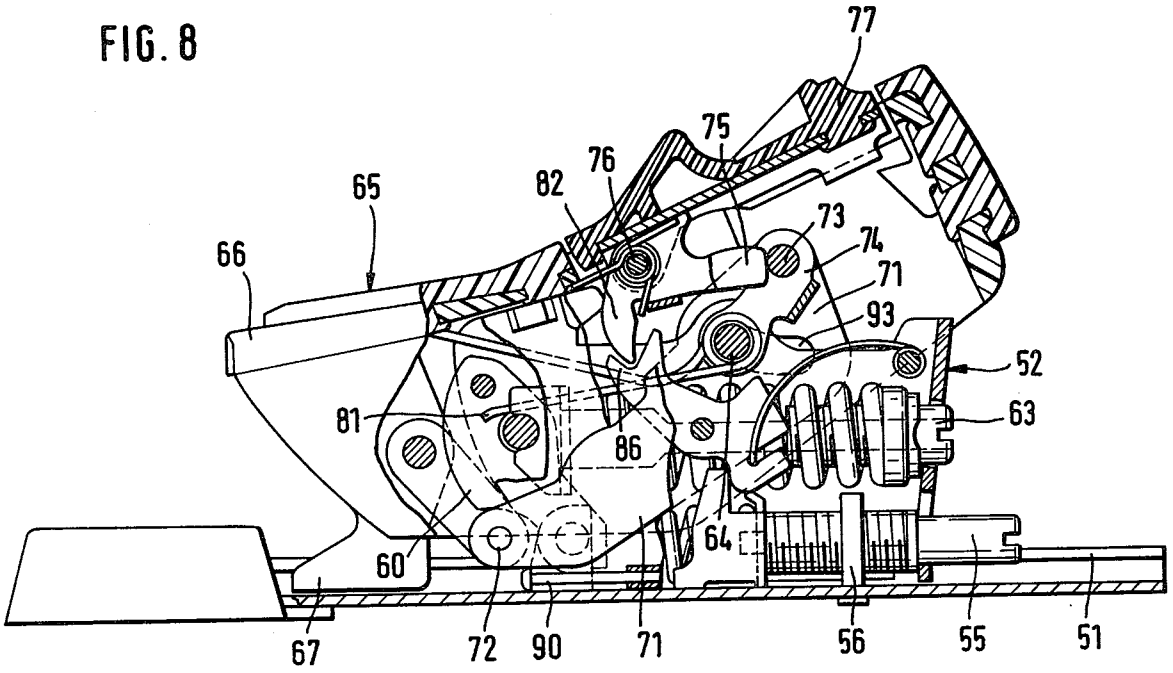
FIG. 8. A longitudinal cross-section according to FIG. 3 in the closed position without an inserted ski shoe.

Manual opening of the heel holder from the closed position of FIG. 3 or FIG. 8 may be achieved by depressing release lever 77. This results in clockwise movement of abutment piece 75 and the release of joint pin 73, allowing sole holder 65 to move into the open position illustrated in FIG. 6 under the influence of opening spring 81 in the same manner as previously described for automatic opening of the sole holder.

Figure 7:
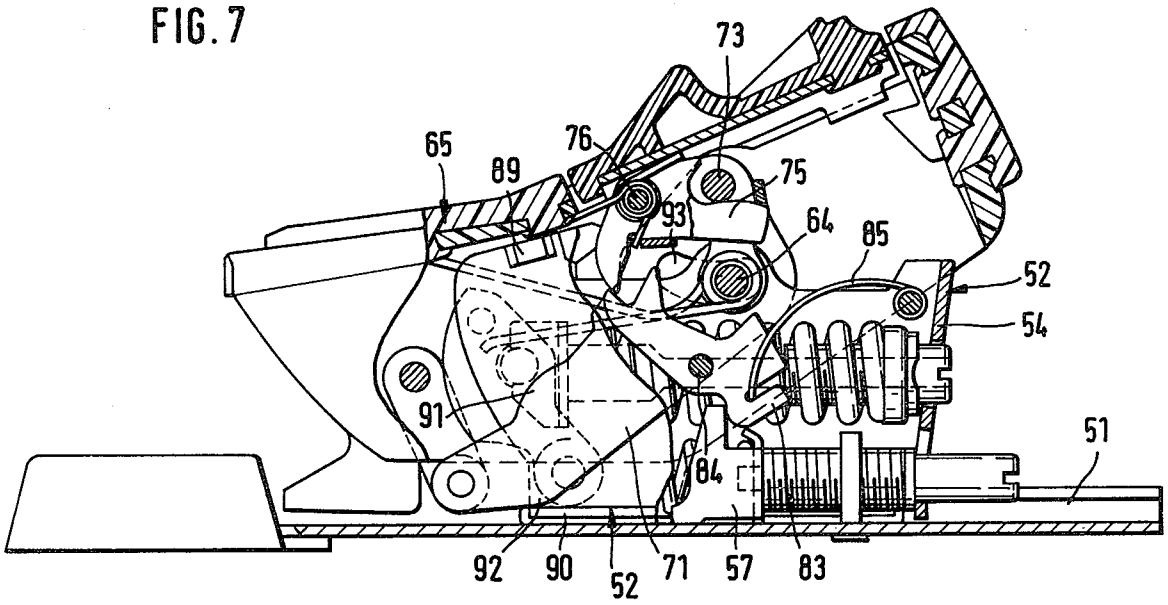
FIG. 7. A longitudinal cross-section according to FIG. 3 in the closing phase without an inserted ski shoe.

A heel holder according to this disclosure may be closed in the conventional manner by stepping into it with a ski boot. Additionally, it is possible to close the sole holder by hand for transportation and storage. This manual closing of the sole holder is illustrated in FIG. 6 to FIG. 8. FIG. 6 shows a sole holder in the fully opened position. For manual closing, release lever 77 is depressed, thus moving abutment piece 75 from the position in which it blocks joint pin 73. Sole holder 65 is then swiveled counterclockwise by hand against the force of opening spring 81. This returns axle 72 toward its original position in which it is blocked by blocking member 60, as illustrated in FIG. 7. Release lever 77 need be depressed only until abutment piece 75 has released joint pin 73.

For the sole holder to retain its closed position after manual closing, joint pin 73 must be returned to a position illustrated in FIG. 8 in which it is blocked by abutment piece 75. This is accomplished through the use of a stop 90 which is preferably the base plate 51 or a piece attached to the base plate 51. During the closing phase connecting arm 71 contacts stop 90. Preferably, a cam 92, part of connecting arm 71, is provided for contacting stop 90. Further closing of the sole holder results in clockwise rotation of connecting arm 71 about the point of contact with stop 90 in such a manner that crank 74 and joint pin 73 are swiveled, allowing abutment piece 75 to move in front of joint pin 73 under the influence of stabilizing spring 79. Axle 72 has, at this point, returned to its original position and is blocked by blocking member 60. The sole holder will remain in its closed position, for release spring 61 is substantially stronger than opening spring 81. Opening of the soleholder from this position is accomplished in the manner previously described for manual opening, requiring only depression of release lever 77.

The invention has been described in detail with particular emphasis on the preferred embodiments, but it should be understood that variations and modifications within the scope and spirit of the invention may occur to those skilled in the art to which the invention pertains.

We claim:

1. A manually releasable heel holder for a safety ski binding, said heel holder comprising:

a housing;

a sole holder pivotally mounted on said housing for movement between a closed position for retaining a ski boot in the holder and an open position for releasing a ski boot, said sole holder including heel holding means for engaging the heel of a ski boot inserted in said heel holder;

biasing means for biasing said sole holder to the open position;

connecting means movably connected at one end thereof to said sole holder for movement between a locking position wherein said connecting means locks said sole holder in the closed position and an unlocking position for enabling said sole holder to move to the open position;

crank means pivotally attached to said housing; hinge means for connecting the other end of said connecting means to said crank means; and manually actuable releasing means movably mounted on said sole holder for movement between a rest position and an actuating position, said releasing means including retaining means for retaining said connecting means in the locking position when said releasing means is in the rest position, and said releasing means releasing said connecting means for movement to said unlocking position in response to movement of said releasing means from the rest position to the actuating position;

wherein said hinge means abutts said retaining means when said releasing means is in the rest position to retain said connecting means in the locking position.

2. The invention according to claim 1 wherein said sole holder further includes locking means pivotally attached to said sole holder, said connecting means being hinged to said locking means to connect said connecting means to said sole holder.

3. The invention according to claim 1 and further comprising: blocking lever means for effecting opening of said sole holder when forces on a ski boot in the binding exceed a predetermined force; closing spring means for applying the predetermined force to said blocking lever means; said blocking lever means including a cam surface, and said connecting means including follower means for following said cam surface to guide said connecting means to the unlocking position in response to movement of said releasing means to the actuating position.

4. The invention according to claim 1 wherein said heel holder further comprises an axle for pivotally attaching said sole holder and said crank on said housing.

5. The invention according to claim 4 wherein said crank means and said connecting means form an acute angle for facilitating movement of said connecting means to the unlocking position in response to movement of said releasing means to the actuating position.

6. The invention according to claim 1 and further comprising means for pivotally mounting said releasing means on said sole holder, and a spring for biassing said releasing means towards the rest position.

7. The invention according to claim 1 and further comprising opening spring means for urging said sole holder from the closed position to the open position.

8. The invention according to claim 1 and further comprising connecting arm spring means for urging said connecting arm from said unlocking position towards said locking position.

9. A heel holder for a safety ski binding, said heel holder comprising:

a housing;

a sole holder pivotally mounted on said housing for movement between a closed position for retaining a ski boot in the holder and an open position for releasing a ski boot, said sole holder including heel holding means for engaging the heel of a ski boot inserted in said heel holder;

biasing means for biasing said sole holder to the open position;

connecting means movably connected to said housing and to said sole holder for movement between a locking position wherein said connecting means locks said sole holder in the closed position and an unlocking position for enabling said sole holder to move to the open position;

an abutting member attached to said connecting means;

releasing means movably mounted on said sole holder for movement between a rest position and a actuating position, said releasing means including abutment means for engaging said abutting member to retain said connecting means in the locking position when said releasing means is in the rest position, and said releasing means releasing said abutting member to release said connecting means for movement to said unlocking position in response to movement of said releasing means from the rest position to the actuating position;

stop means on said housing for engaging said connecting means to control the path of movement of said connecting means upon movement of said sole holder toward the open position; and guide means for guiding said abutting member into engagement with said abutment means when said housing engages said stop means.

10. The invention according to claim 9 and further comprising: crank means pivotally attached to said housing, and hinge pin means attaching said connecting means to said crank means, said hinge pin means forming said abutting member.

11. The invention according to claim 10 wherein said abutment means comprises an abutment piece having an abutment surface and a sliding surface, said hinge pin moving from said abutment surface to said sliding surface when said releasing means moves from the rest position to the actuating position, and said hinge pin moving from said sliding surface to said abutment surface when said connecting means engages said stop means.

12. A manually closable heel holder for a safety ski binding, said heel holder comprising:

a housing;

a sole holder pivotally mounted on said housing for movement between a closed position and an open position;

biasing means for biasing said sole holder to the open position;

connecting means movably connected to said housing and to said sole holder for movement between an open-locking position wherein said connecting means locks said sole holder in the open position and closed-locking position wherein said connecting means locks said sole holder in the closed position;

manually actuable releasing means movably mounted on said sole holder for movement between a rest position and an actuating position, said releasing means including retaining means for retaining said connecting means in the open-locking position when said releasing means is in the rest position, and said releasing means releasing said connecting means for movement towards said closed-locking position in response to movement of said releasing means from the rest position to the actuating position; and holding means for holding said connecting means in the closed-locking position after manual actuation of said releasing means said holding means including guide means for guiding said connecting means into the closed locking position and for guiding said connecting means into a retained position relative to said retaining means to retain said connecting means in the closed locking position in response to the movement of said sole holder from the open position towards the closed position.

13. The invention according to claim 12 wherein said connecting means includes a connecting arm, and wherein said connecting arm includes an abutment member engageable by said retaining means for retaining said connecting arm in the closed-locking position, and further comprising:

a locking lever pivotally mounted on said sole holder;

roller means connecting said connecting arm to said locking lever means; and blocking lever means for effecting opening of said sole holder when forces on a ski boot in the binding exceed a predetermined force;

wherein said guide means comprises connecting arm guide means for guiding said roller means into blocking engagement with said blocking lever means and said abutment member into engagement with said retaining means to hold said connecting arm in the closed-locking position in response to the movement of said sole holder from the open position towards the closed position.

* * * * *